US009439832B2

(12) United States Patent
Trombley et al.

(10) Patent No.: US 9,439,832 B2
(45) Date of Patent: Sep. 13, 2016

(54) CHILD-RESISTANT BLISTER PACKAGE

(71) Applicant: The Procter & Gamble Company, Cincinnati, OH (US)

(72) Inventors: Kurt Franklin Trombley, Loveland, OH (US); Karen Lai-Ting Chan, Villa Hills, KY (US); Isabelle Lafosse-Marin, West Chester, OH (US); Jay Robert Morosey, Jr., Maineville, OH (US); Karla Mishell Sanchez, Cincinnati, OH (US); Kelly Lee Schmeichel, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 259 days.

(21) Appl. No.: 14/048,061

(22) Filed: Oct. 8, 2013

(65) Prior Publication Data

US 2015/0096920 A1 Apr. 9, 2015

(51) Int. Cl.

| | |
|---|---|
| ***B65D 83/04*** | (2006.01) |
| ***A61J 1/03*** | (2006.01) |
| ***B65D 75/36*** | (2006.01) |

(52) U.S. Cl.

CPC ..... *A61J 1/035* (2013.01); *B65D 75/36* (2013.01); *B65D 75/367* (2013.01); *B65D 2215/00* (2013.01); *B65D 2575/367* (2013.01)

(58) Field of Classification Search

CPC .. B65D 75/327; B65D 75/36; B65D 75/367; B65D 2215/00; B65D 2575/367; A61J 1/035

USPC ..... 206/528, 530, 531, 532, 534, 538, 539

See application file for complete search history.

(56) References Cited

U.S. PATENT DOCUMENTS

| | | | | |
|---|---|---|---|---|
| 3,759,371 | A | 9/1973 | Marks | |
| 4,295,567 | A | 10/1981 | Knudsen | |
| 4,362,000 | A | 12/1982 | Poore | |
| 370,625 | A | 6/1996 | Kelsey et al. | |
| 5,613,609 | A | 3/1997 | Hamilton et al. | |
| 6,270,796 | B1 | 8/2001 | Weinstein | |
| 6,375,956 | B1 | 4/2002 | Hermelin et al. | |
| 6,564,945 | B1 | 5/2003 | Weinstein et al. | |
| 6,951,282 | B2 * | 10/2005 | Jones | B65D 75/367 206/531 |
| 7,144,635 | B2 | 12/2006 | Hawes et al. | |
| 7,188,728 | B2 | 3/2007 | Williams-Hartman | |

(Continued)

FOREIGN PATENT DOCUMENTS

| | | |
|---|---|---|
| DE | 20316565 | 3/2005 |
| DE | 202012009135 | 12/2012 |

(Continued)

*Primary Examiner* — Luan K Bui

(74) *Attorney, Agent, or Firm* — Alexandra S. Anoff

(57) ABSTRACT

A child-resistant blister package. The package has a top face, a bottom face, and a periphery. The package also has a protection layer with a top face, a bottom face and a periphery; a blister layer with one or more cavities; and an access layer with a top face, a bottom face, and a periphery. The bottom face of the access layer has a line of weakness that allows the unit dose to be removed from the cavity in one-step by applying a force to the top of the cavity and pressing the unit dose through the line of weakness. The bottom face of the protection layer and the top face of the access layer are permanently joined along substantially the entire periphery of the package. The blister package can also contain a tear resistant layer.

16 Claims, 16 Drawing Sheets

(56) References Cited

U.S. PATENT DOCUMENTS

| | | | | |
|---|---|---|---|---|
| 7,328,802 | B2 | 2/2008 | Killinger | |
| 8,328,018 | B2 | 12/2012 | Sack et al. | |
| 2002/0162768 | A1* | 11/2002 | Bolnick | A61J 1/035 206/532 |
| 2003/0111379 | A1* | 6/2003 | Intini | B65D 75/367 206/531 |
| 2003/0234203 | A1* | 12/2003 | Urban | B65D 75/327 206/530 |
| 2004/0245145 | A1 | 12/2004 | Urban | |
| 2005/0241983 | A1 | 11/2005 | Snyder et al. | |
| 2006/0102512 | A1* | 5/2006 | Lo Duca | B65D 75/327 206/531 |
| 2006/0249421 | A1* | 11/2006 | Pham | B32B 3/266 206/531 |
| 2007/0080090 | A1* | 4/2007 | Gherdan | B65D 83/0463 206/531 |
| 2007/0151893 | A1* | 7/2007 | Barndt | B65D 83/0463 206/531 |
| 2007/0224379 | A1 | 9/2007 | Stevenson | |
| 2007/0235366 | A1* | 10/2007 | Desai | B65D 75/327 206/531 |
| 2008/0110791 | A1* | 5/2008 | Specker | B65D 75/327 206/531 |
| 2008/0135441 | A1* | 6/2008 | Meliniotis | A61M 15/0045 206/531 |
| 2008/0230432 | A1* | 9/2008 | Bobbett | B65D 75/327 206/531 |
| 2009/0107873 | A1* | 4/2009 | Cotton | B65D 75/327 206/531 |
| 2009/0178949 | A1* | 7/2009 | Reilley | B65D 75/327 206/531 |
| 2009/0283440 | A1 | 11/2009 | Krumme | |
| 2010/0108559 | A1* | 5/2010 | Kohl | A61J 1/035 206/531 |
| 2010/0122927 | A1 | 5/2010 | Matsuoka et al. | |
| 2012/0111761 | A1* | 5/2012 | Sack | B65D 75/327 206/531 |

FOREIGN PATENT DOCUMENTS

| | | |
|---|---|---|
| GB | 2081227 | 2/1982 |
| WO | WO 2005/056419 | 6/2005 |

* cited by examiner

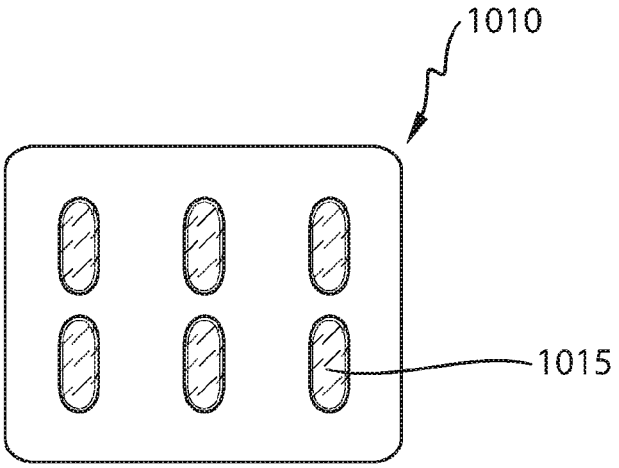
Fig. 10
Fig. 11A
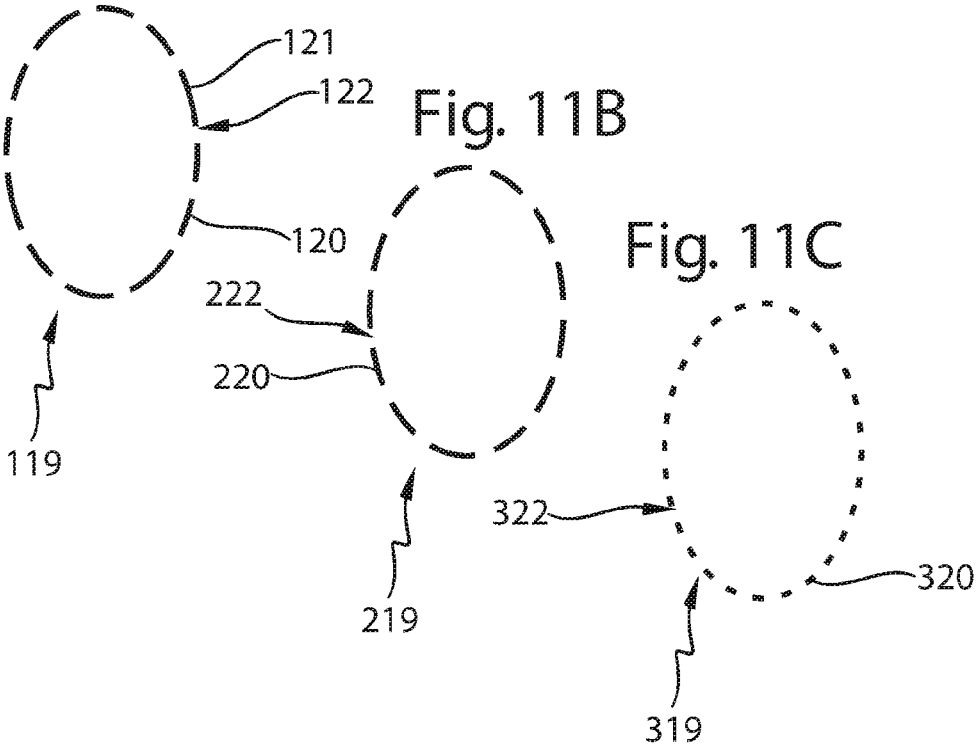

CHILD-RESISTANT BLISTER PACKAGE

CROSS REFERENCE TO RELATED APPLICATION

This application claims the benefit of U.S. Provisional Application No. 61/710,925 filed Oct. 8, 2012.

FIELD OF INVENTION

The present invention is generally directed to child-resistant packages, and more particularly, to child-resistant blister packages.

BACKGROUND OF THE INVENTION

Medicines are typically packaged in bottles, cartons, blister packages, or other suitable packaging prior to use. These packages routinely include child-resistant features to reduce the risk of a small child accessing and ingesting the medication.

Child-resistant features generally require some combination of dexterity, strength, and intellect to operate, such as for example, with a two-step process. For example, a child-resistant bottle cap could include a mechanism that must be squeezed while it is turned and opened. A child-resistant blister package could include a layer that must be peeled away or a tab that must be exposed and activated before the medicine can be accessed by conventional methods of pushing the medicine through the foil layer of the blister package. Such packages are designed to be difficult for young children to access; however, an unintended consequence can be that the elderly, those with poor eyesight, and those physically handicapped by diseases such as arthritis also can have difficulty opening such packages.

As such, there remains a need for an improved child-resistant package that is difficult for small children to open, yet easier for adults to open than conventional child-resistant packages. There also remains a need for an improved child-resistant blister package that is convenient to manufacture and carry. Furthermore, there remains a need for a child-resistant blister package that can provide stringent levels of child-resistance using a one-step process.

SUMMARY OF THE INVENTION

A child-resistant blister package having a top face, a bottom face, and a periphery, the package comprising: (a) a protection layer comprising a top face, a bottom face, and a periphery; (b) a blister layer comprising a top face, a bottom face, and a periphery wherein one or more cavities are formed therein, wherein a cavity contains at least one unit dose; (c) an access layer comprising a top face, a bottom face, and a periphery wherein the access layer has a line of weakness on the bottom face that extends at least partially towards the top face; wherein substantially the entire periphery of the blister layer is disposed between the protection layer and the access layer; wherein the bottom face of the protection layer and the top face of the access layer are permanently joined along substantially the entire periphery of the package; wherein the unit dose can be removed from the cavity in one-step by applying a force to the top of the cavity and pressing the unit dose through the line of weakness.

BRIEF DESCRIPTION OF THE DRAWINGS

While the specification concludes with claims particularly pointing out and distinctly claiming the subject matter of the present invention, it is believed that the invention can be more readily understood from the following description taken in connection with the accompanying drawings, in which:

FIG. 10 is a top view of a child-resistant blister package;

FIG. 11A is an exemplary perforation pattern;

FIG. 11B is an exemplary perforation pattern;

FIG. 11C is an exemplary perforation pattern;

DETAILED DESCRIPTION OF THE INVENTION

Figure 1A:
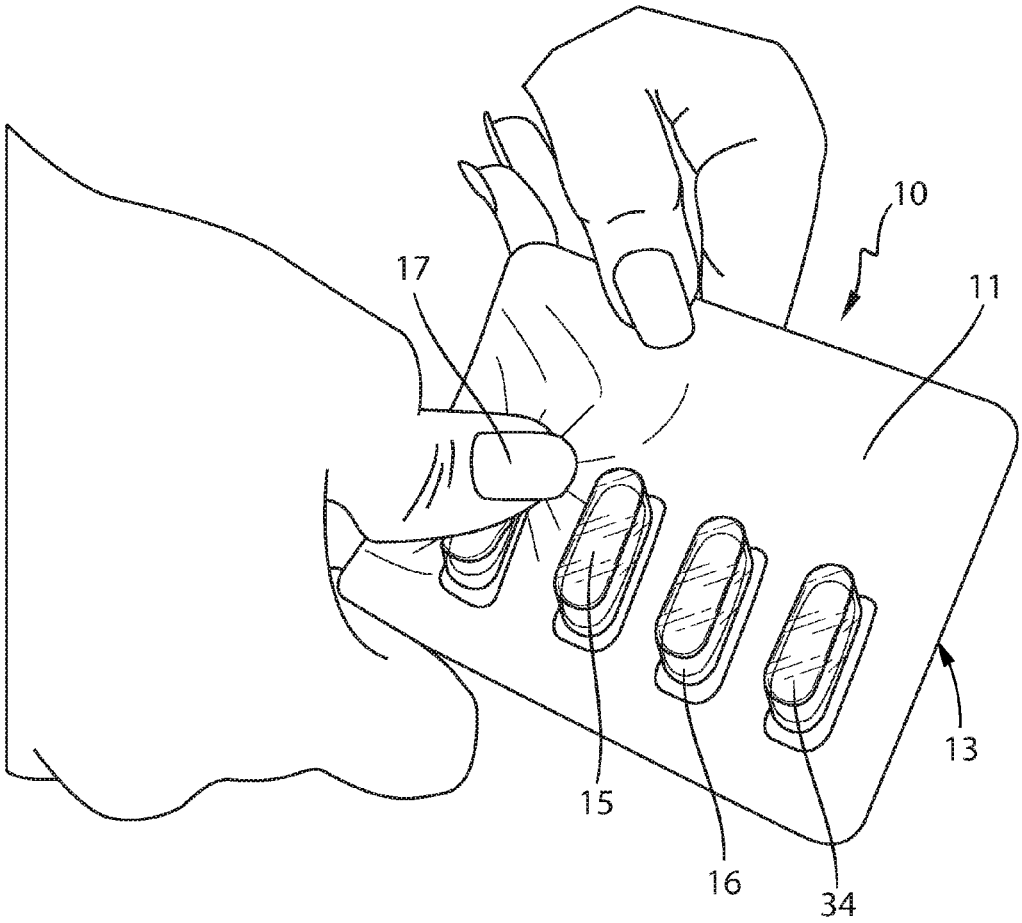
FIG. 1A is a perspective view of the top of a child-resistant blister package.

The present invention relates to child-resistant blister packages that employ a one-step push through mechanism. Although such packages only require one step to access the medication contained therein, the packages still meet the definition of child-resistant under the Poison Prevention Packaging Act. Specifically, such packages meet the definition of an F=5 package under the Poison Prevention Act.

The packages can have a protection layer, a blister layer that includes cavities adapted to contain at least one unit dose of medication, and an access layer. The access layer can include a line of weakness that allows access to the medication via a one-step action where force is applied to the top of the blister layer cavity such that the medication is pressed through the line of weakness. The periphery of the blister layer can be disposed between the safety layer and the access layer, and the safety layer and the access layer are permanently joined along substantially the entire periphery of the package and/or unit dose.

The inventive child-resistant blister packages are surprisingly difficult for small children to access, yet require only low levels of force by adults to remove the medication from the blister cavities. In addition, the inventive child-resistant blister packages do not typically require instructions to open. The blister packages can include any suitable number of doses and/or cavities, including, for example, a daily dosage regimen. In packages having two or more cavities, the distance between the cavities can be sufficient to prevent consecutive failures during child-resistant testing, while still providing a portable convenient package that can be opened with low levels of force.

As used herein, "active" includes all compounds and compositions that can be used to treat and/or prevent illness and/or provide overall health and wellness benefits in mammals. Non-limiting examples of particularly useful actives include non-prescription and prescription actives, vitamins, minerals, elements, plant-derived materials, energy boosting materials, probiotics, fiber, prebiotics, and combinations thereof.

As used herein, "blister package" refers to packaging for unit doses. In general, a blister package typically includes a top face, which is the side that includes one or more cavities, an opposite bottom face through which the unit dose is removed from the cavity, and a periphery. Blister packages may come in any variety of shapes such as rectangular, rounded such as circular, and the like.

The term "cavity" refers to an enclosure formed by an outer covering that is raised at the face thereby forming a compartment for housing a unit dose.

As used herein, "child-resistant packaging" means packaging that is designed or constructed to be significantly difficult for young children to open or obtain a toxic or harmful amount of the substance contained therein within a reasonable time and not difficult for normal adults to use properly, but does not mean packaging which all such children cannot open or obtain a toxic or harmful amount within a reasonable time.

As used herein, "gained access to" means that the dosage units have been removed or can be removed in whole or in part. Additionally, if a cavity or blister is breached and the contents are not removed, this is still considered access.

As used herein, "indicia" provides information to a potential user or user of the systems, dosage units (e.g. the active contained therein) and blister packages. The indicia can comprise many forms and present the information in many ways and in many types of media. Non-limiting examples of types of indicia include alpha-numeric indicia, pictures, drawings, illustrations, photographs, computer-produced images, colors, sounds, textures, shapes, symbols, letters, numbers, and combinations thereof. In certain examples, "indicia" does not include instructions for opening the package.

As used herein, "joined" refers to configurations in which a first element is directly secured to a second element. Joined also includes configurations in which the first element is indirectly secured to the second element.

As used herein, "kiss cut", refers to a continuous slit.

As used herein, "line of weakness", refers to one or more weakness points arranged such that the material can be more easily torn or broken along a particular line. Non-limiting examples of a line of weakness can include a perforation pattern, a kiss cut, or combinations thereof.

As used herein, "opening force", refers to the force that is applied to the top face of the blister layer to rupture the bottom face of access layer. The opening force can be measured using the Force Test Method described hereafter.

As used herein, "perforation pattern", refers to a series of holes or slits.

As used herein, "permanently joined" refers to configurations in which a first element is secured to a second element such that the elements generally cannot be separated from one another without at least partially destroying one or both of the elements.

As used herein, "push through pack", means a type of blister pack in which the primary method of tablet/capsule removal is through a downward push force on the blister cavity.

As used herein, "tear resistant" means capable of experiencing stress and/or deformation without experiencing a significant loss of integrity.

The term "unit dose" or "unit dosage" means a dosage form containing an amount of an active or nutrient suitable for administration in one single dose, according to sound medical practice. The dosage form may include a variety of product forms. Non-limiting examples of the most common dose forms include, but are not limited to compressed tablets, caplets, softgel capsules, solid-filled capsules, liquid-filled capsules, enteric-coated forms, sustained-release forms, solid lozenges, liquid-filled lozenges, mouth and throat drops, effervescent tablets, orally disintegrating tablets and combinations thereof. Dosage forms are typically swallowed immediately, slowly dissolved in the mouth, or chewed.

FIG. 1A shows a perspective view of the top face 11 of a child-resistant blister package 10. The blister package 10 also has a periphery 13. In the example in FIG. 1A, the child-resistant blister package 10 has four distinct cavities 15 and each cavity 15 contains one unit dose 16. FIG. 1A shows a force 17 that is applied to the top of the cavity 34. In one example, the force 17 is applied with one thumb.

Figure 1B:
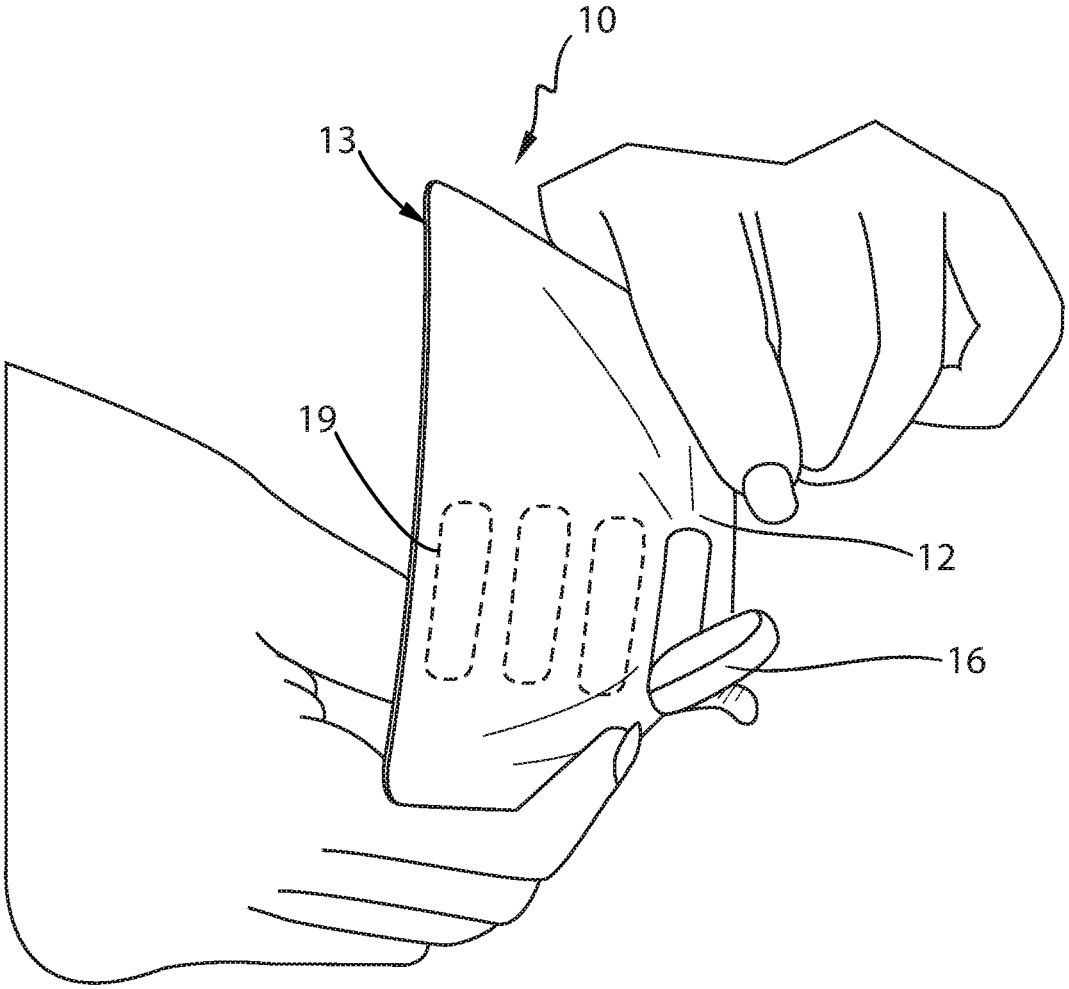
FIG. 1B is a perspective view of the bottom of a child-resistant blister package.

FIG. 1B shows a perspective view of the bottom face 12 of a child-resistant blister package 10 with periphery 13. The bottom face has a perforation pattern 19. A force is applied to the top of the blister cavity and the unit dose 16 is pushed out through the perforation pattern 19.

Figure 2A:
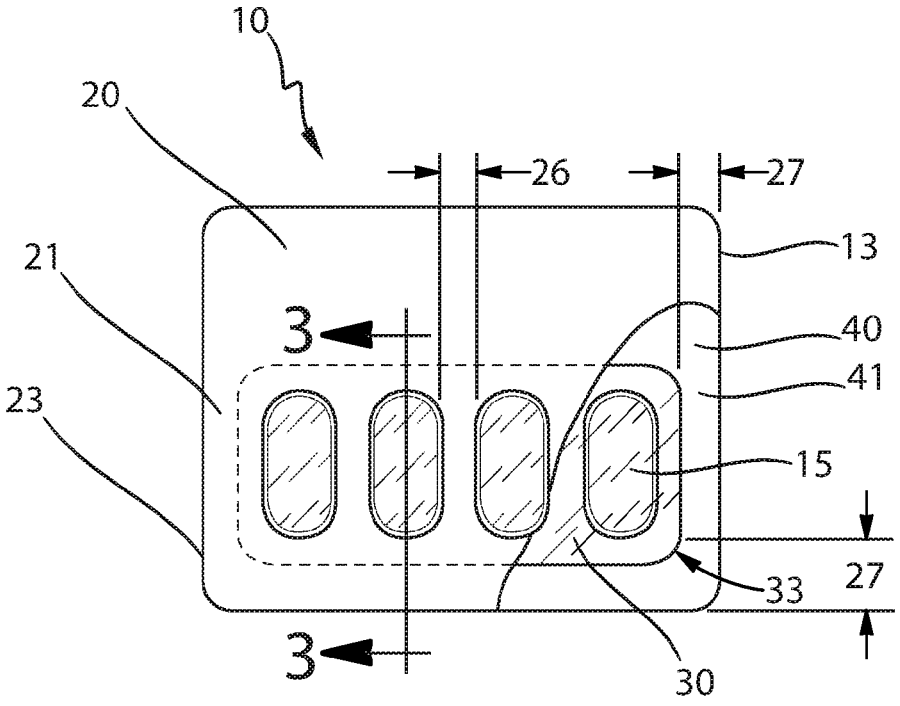
FIG. 2A is a top cut-away view of an a child-resistant blister package.

FIG. 2A shows a top cut-away view of a child-resistant blister package 10. There is a protection layer 20 that has a top face 21 and a periphery 23, a blister layer 30, and an access layer 40 that has a top 41. The region between the cavities 26 is the area between the cavities 15. In one example, the region between the cavities 26 is large enough that it can help maintain the child-resistant properties of the package. The joined region is the distance from the periphery of the blister layer 33 to the periphery of the blister package 13. In one example, the joined region 27 can be a certain length and help maintain the child-resistance of the package 10.

Figure 2B:
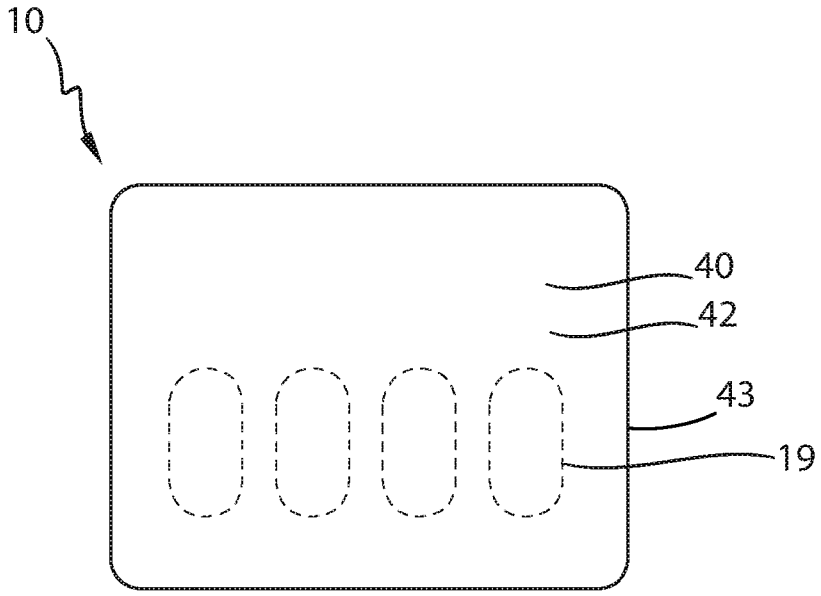
FIG. 2B is a back view of an example of the child-resistant blister package.

FIG. 2B shows a bottom view of a child-resistant blister package 10. There is an access layer 40 that has a bottom face 42 and a periphery 43. The access layer 40 comprises a perforation pattern 19.

Figure 3:
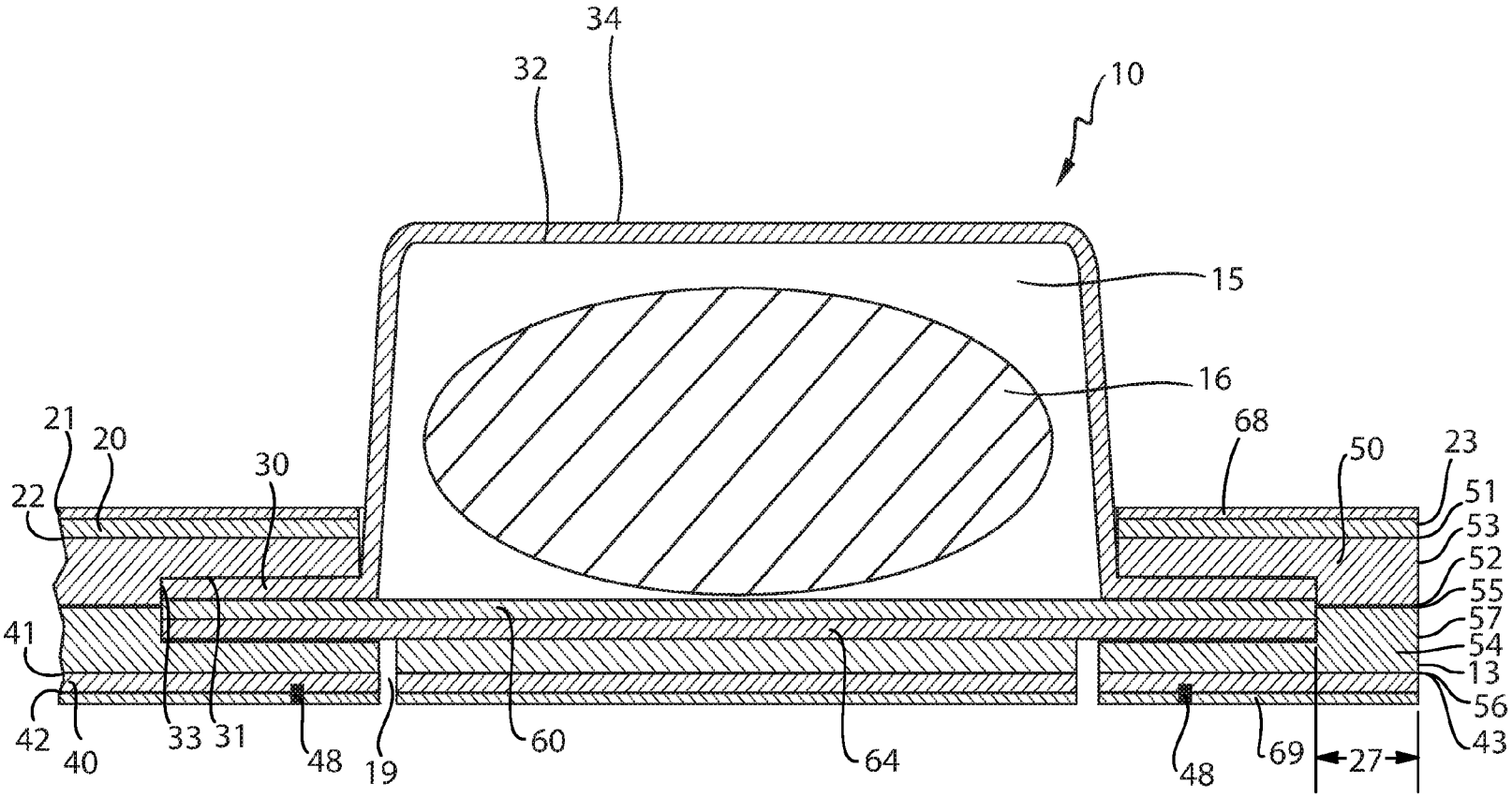
FIG. 3 is a cross-sectional view of FIG. 2A and FIG. 2B.

FIG. 3 shows a cross-sectional view of the child-resistant blister package 10 from FIG. 2A and FIG. 2B. The blister package has a periphery 13 and comprises several layers including a first printable layer 68, a protection layer 20, a first tear resistant layer 50, a blister layer 30, a second tear resistant layer 54, an access layer 40, and a second printable layer 69. The protection layer 20 has a top face 21, a bottom face 22, and a periphery 23. The blister layer 30 has a top face 31, a bottom face 32, and a periphery 33. The blister layer 30 is made into a cavity 15 that contains one unit dose 16 and the cavity 15 has a top of the cavity 34. In one example, the first tear resistant layer 50 is located between the protection layer 20 and the second tear resistant layer 54. The first tear resistant layer has a top face 51, a bottom face 52, and a periphery 53. In one example, the second tear resistant layer 54 is located between the first tear resistant layer 50 and the access layer 40. The second tear resistant layer 54 has a top face 55, a bottom face 56 and a periphery 57. The access layer has a top face 41, a bottom 42, and a periphery 43.

FIG. 3 also shows perforation pattern 19. In one example, the perforation pattern 19 can extend through the second printable layer 69, the access layer 40, and the second tear resistant layer 54. In one example, the perforation pattern 19 does not extend past the top face 57 of the second tear resistant layer. The blister package can also have a kiss cut 48. The kiss cut 48 can extend through the printable layer 69 and partially into the access layer 40. In one example, the kiss cut does not extend past the top face 42 of the access layer. Underneath the cavity 15 is the lidding layer 60 and the second lidding layer 64.

FIG. 3 also shows the joined region 27 and the joined region can be formed when the bottom face 22 of the protection layer and the top face of the access layer 41 are permanently joined along substantially the entire periphery of the blister package 10. In another example, the joined region 27 is joined when the first tear resistant layer 50 and the second tear resistant layer 54 are joined along substantially the entire periphery of the blister package 10.

Figure 4A:
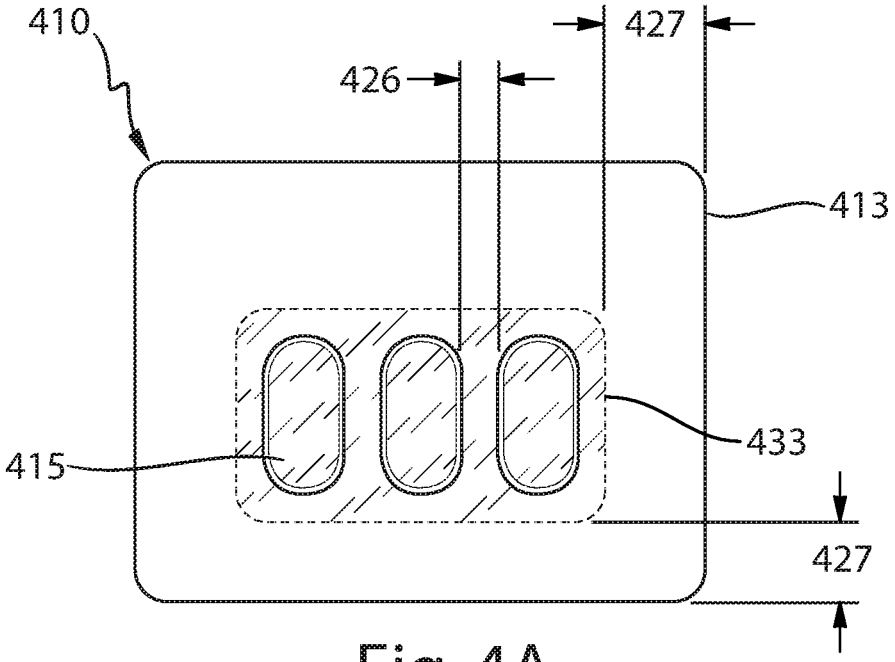
FIG. 4A is a top view of a child-resistant blister package.

FIG. 4A shows the top view of the child-resistant blister package 410. This example shows three cavities 415. The region between the cavities 426 is the area between the cavities 415. The joined region 427 is the distance from the periphery of the blister layer 433 to the periphery of the blister package 413.

Figure 4B:
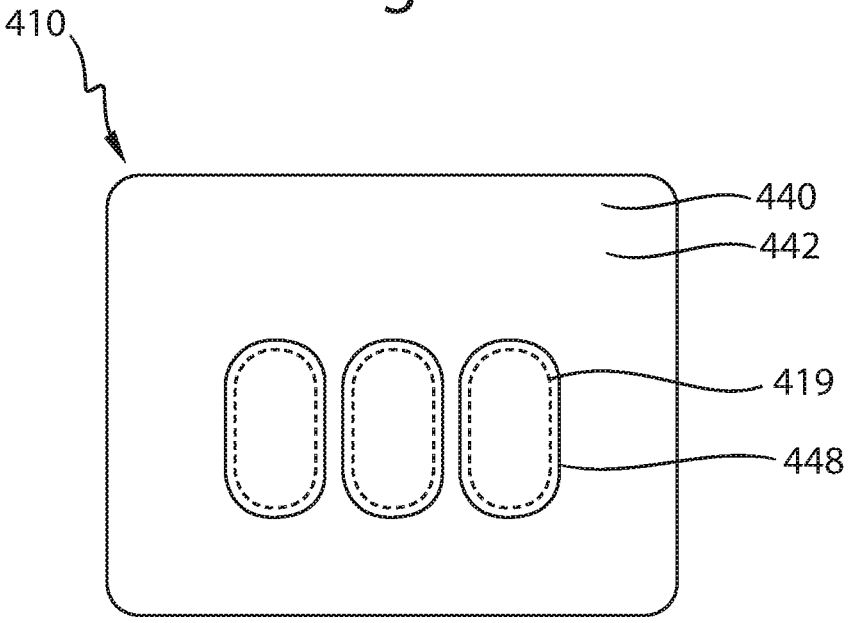
FIG. 4B is a bottom view of a child-resistant blister package.

FIG. 4B shows the bottom view of a child-resistant package 410 and the access layer 440 with bottom face 442. The perforation pattern 419 is surrounded by a kiss cut 448.

Figure 5A:
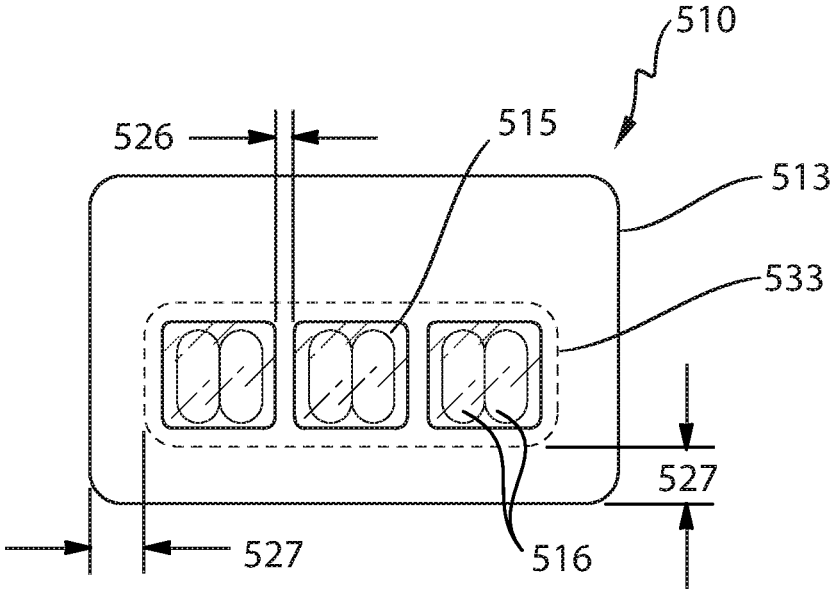
FIG. 5A is a top view of a child-resistant blister package.

FIG. 5A shows the top view of the child-resistant blister package 510. This example shows three cavities 515 containing two unit doses 516 per cavity 515. The region between the cavities 526 is the area between the cavities 515. The joined region 527 is the distance from the periphery of the blister layer 533 to the periphery of the blister package 513.

Figure 5B:
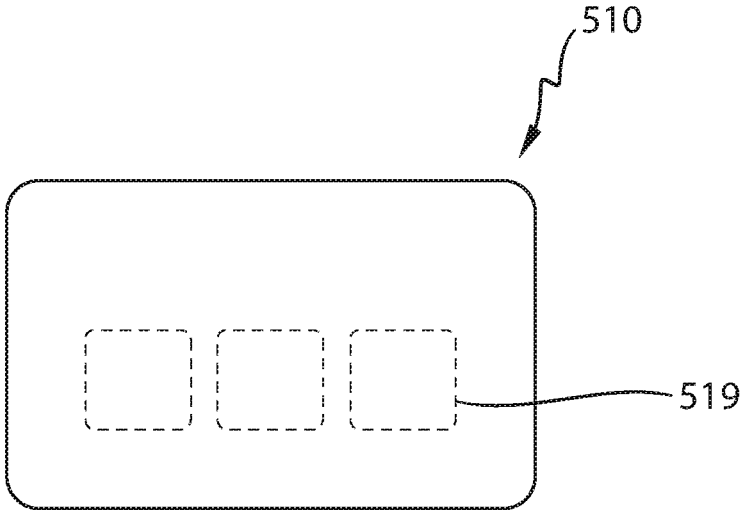
FIG. 5B is a bottom view of a child-resistant blister package.

FIG. 5B shows the bottom view of a child-resistant blister package 510 with perforation pattern 519.

Figure 6:
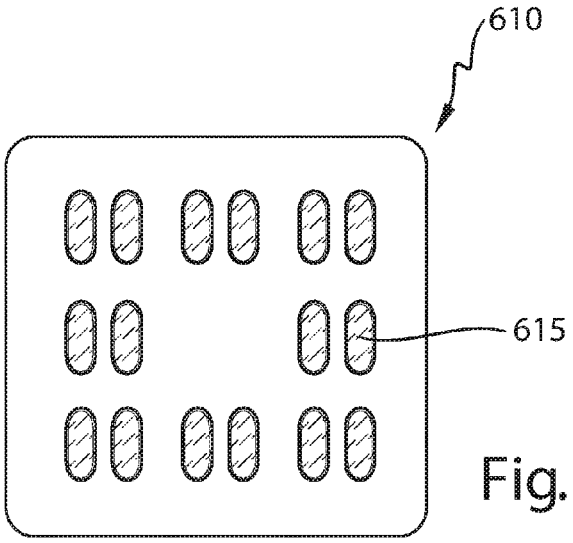
FIG. 6 is a top view of a child-resistant blister package.

FIG. 6 shows another example of a child-resistant blister package 610 with sixteen cavities 615.

Figure 7:
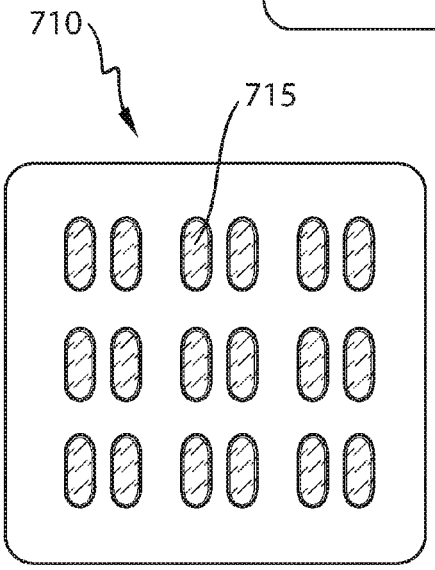
FIG. 7 is a top view of a child-resistant blister package.

FIG. 7 shows another example of a child-resistant blister package 710 with eighteen cavities 715.

Figure 8:
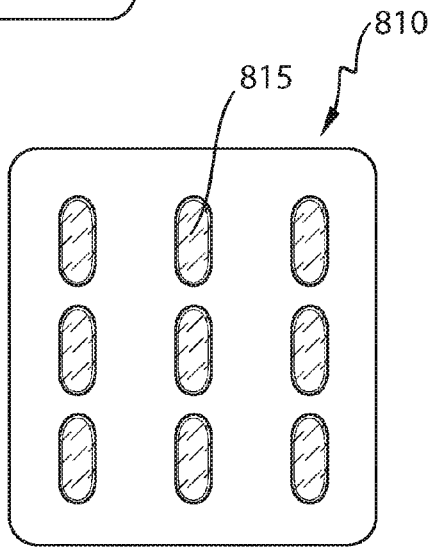
FIG. 8 is a top view of a child-resistant blister package.

FIG. 8 shows another example of a child-resistant blister package 810 with nine cavities 815.

Figure 9:
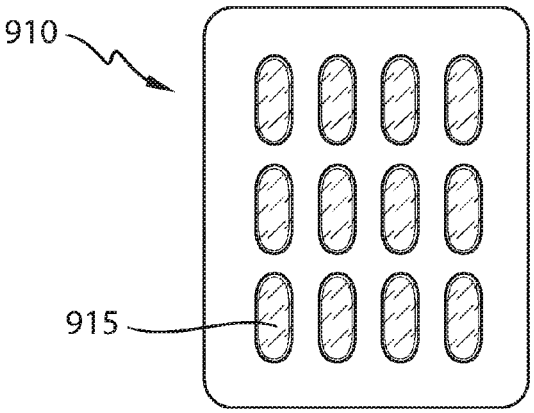
FIG. 9 is a top view of a child-resistant blister package.

FIG. 9 shows another example of a child-resistant blister package 910 with twelve cavities 915.

FIG. 10 shows another example of a child-resistant blister package 1010 with six cavities 1015.

FIG. 11A shows an exemplary perforation pattern, the X perforation pattern 119. The X perforation pattern 119 has cut areas 120 and 121 and land areas 122.

FIG. 11B shows an exemplary perforation pattern, the Y perforation pattern 219. The Y perforation pattern 219 has cut areas 220 and land areas 222.

FIG. 11C shows an exemplary perforation pattern, the Z perforation pattern 319. The Z perforation pattern 319 has a cut area 320 and land areas 322.

Surprisingly, a push through blister package can be child-resistant and only require one step to open. For example, the blister package of the present invention does not require two or more steps to open it. The blister package of the present invention does not require the user to peel off an outer-nonfrangible layer, such as stiff paper, to expose an underlying frangible layer, such as thin foil. The blister package of the present invention also does not require a user to perform the bend-peel-push method where the user bends the entire blister package to expose the pull-tab and then the pull-tab may be used to peel away the outer layer of the card such that only the frangible layer remains. Furthermore, the blister package of the present invention does not require the user to press on or break a certain area of the blister package to create a pull tab. Additionally, the blister package of the present invention is not opened by tearing the package open along a notch that is a cut-out or slit along an edge of the package.

Surprisingly, in one example, no written indicium of any kind are needed to direct a user how to open the blister package and therefore the package contains no instructions. While not wishing to be bound by theory, it is believed that this is possible because applying the force to the top of the cavity and pressing the unit dose through the perforation pattern is intuitive for adults, yet not intuitive for small children. In one example, the blister package requires no alpha-numeric instructions but may have illustrations or other graphics to explain how to open the package.

The force required to access the unit dose in the package configurations provided herein depends on several factors including: the perforation pattern, whether or not a tear resistant layer is present, the thickness of the protection layer and the access layer, the size of the blister package, the hardness of the cavity, and the number and size of unit doses inside the cavities. By varying these factors and others, it is possible to adjust the force required to open the blister package into a range that is difficult for children to administer yet easy for adults to apply. By adjusting the force into this range in combination with the package configurations provided herein, it is possible to have a package that is both child-resistant and acceptable to adults. If the package is acceptable to adults, it can be easier to open than other child-resistant packages. In some examples, adjusting the force can allow the blister package to be opened by people who often have difficulty opening child-resistant packaging such as the elderly, adults with poor eyesight, and/or adults who are physically handicapped by diseases such as arthritis, while maintaining high levels of child-resistance.

In one example, the opening force is 20 N to 250 N, in another example 50 N to 225 N, in another example 75 N to 200 N, and in another example 100 N to 175 N. In one example, the opening force is less than 200 N, in another example less than 175 N, in another example less than 150 N, and in another example less than 125 N. The opening force can be determined by the force testing method described hereafter.

The joined region should be sufficient to prevent children from accessing the unit doses. While not wishing to be bound by theory, Applicants believe that this is because if the joined region is too small, the seal between the protection layer and the access layer is not strong enough and children are able to access the pills by peeling apart the layers. When the joined region is larger the seal is stronger and more difficult for the children to tear apart which increases the child resistance of the package. In one example, the joined region is greater 0.2 inches (in) (0.508 cm), greater than 0.3 in (0.762 cm), greater than 0.4 in (1.016 cm), greater than 0.45 in (1.143 cm), greater than 0.5 in (1.27 cm), and greater than 0.55 in (1.397 cm). In a different example, the joined region is from 0.2 (0.508 cm) in to 0.7 in (1.778), from 0.3 in (0.762 cm) to 0.7 in (1.778 cm), and from 0.4 in (1.016 cm) to 0.7 in (1.778 cm).

In addition, the distance between the cavities should be sufficient to prevent a child from accessing additional unit doses, once one dose is accessed, leading to consecutive failures. In one example the distance between the cavities is greater than 2 mm, in another example greater than 5 mm, in another example greater than 7 mm, in another example greater than 9 mm, in another example greater than 10 mm, and in another example greater than 11 mm. In another example the distance between the cavities is from 2 mm to 15 mm, in another example from 5 to 13 mm, and in another example from 8 to 12 mm.

The child-resistant blister package can have a line of weakness that helps the consumer access the unit dose inside. Non-limiting examples of a line of weakness can include a perforation pattern, a kiss cut, and combinations thereof. In one example, the perimeter of the line of weakness can be the same general shape as the cavity. In a different example, the perimeter of the line of weakness can be a different shape as the cavity.

In one example, the line of weakness is the same shape as the footprint of the unit dose or cavity. In one example, the footprint of the line of weakness can be from 80% to 150% of the area of the unit dose or cavity, in another example from 85% to 130% of the area of the unit dose or cavity, in another example from 90% to 120% of the area of the unit dose or cavity.

In an example, the line of weakness is a perforation pattern. The perforation pattern can be important in both making the package child-resistant and determining the force that is required to open the package. The package can be made more difficult to open by changing the perforation pattern. For example, if the cuts in the perforation pattern are too large, a child can more easily access the unit doses by ripping or peeling the package along the perforation pattern. Alternatively, if there is too much land it increases the force and makes it difficult for a consumer to access the unit doses.

The perforation pattern can be a regular repeating pattern, an alternating pattern, an irregular pattern, and combinations thereof. The perforation pattern can be symmetrical or asymmetrical around the perimeter of the perforation pattern.

The ratio of cut to land length relates to the child-resistant function as does the actual length of each cut. In one example, the cut to land ratio of the perforation pattern is from 8:1 to 3:1, in another example from 4:1 to 1.5:1, in another example from 5:1 to 1:4, in another example from 3:1 to 1:3, in another example from 2:1 to 1:2, in another example from 1.5:1 to 1:1.5, and in another example from 1.25:1 to 1:1.25. In one example, the cut to land ratio is 1:1. In one example, as the ratio of cut to land increases, the force required to open the blister package decreases and as the ratio of cut to land decreases, the force required to open the blister package increases.

In one example, the maximum length of any cut in the perforation pattern is less than 8 mm, in another example less than 7 mm, in another example less than 6 mm, in another example less than 5 mm, in another example less than 3 mm, in another example less than 2 mm, and in another example less than 1.5 mm. In one example, the maximum length of any land in the perforation pattern is less than 2 mm, in another example less than 1.5 mm, in another example less than 1 mm, in another example less than 0.75 mm, and in another example less than 0.5 mm.

In one example the perforation pattern has from 8 cuts to 20 cuts, in another example from 10 cuts to 18 cuts, and in another example from 11 cuts to 15 cuts. In another example, the perforation pattern has from 20 cuts to 43 cuts, in another example from 23 cuts to 40 cuts, and in another example from 28 cuts to 35 cuts.

In another example, the child-resistant package has a kiss cut. The kiss cut is generally located on the bottom face of the access layer. Surprisingly, it has been found that a kiss cut can help prevent consecutive failures and/or reduce tearing of the access layer which could destroy indicia, such as regulatory text. In one example, the access layer comprises both a kiss cut and a perforation pattern. In another example, the kiss cut can substantially surround the perforation pattern. In another example, the kiss cut does not surround the perforation pattern. In another example, the line of weakness comprises one or more kiss cuts and there is not a perforation pattern.

The protection layer and the access layer can be selected from any suitable material including metal, cellulose, polymers, and combinations thereof. In another example, the protection layer and the access layer are made out of different materials. In another example, the protection layer and the access layer are made out of the same material.

In one example, the protection layer and/or the access layer are made out of paperboard. The paperboard must be thick enough and strong enough that it provides child-resistance in the package configurations provided herein. The paperboard can be any suitable weight and any suitable thickness. Surprisingly, it has been found that if the paperboard is not thick enough, then the children can either peel it apart or rip it to access the unit doses. Another way that children are able to access the unit doses is by saturating the board with saliva which eventually soaks the board and allows the children to access unit doses. While not wishing to be bound by theory, if the board is thick enough it can increase child resistance because the children cannot peel enough layers to access the unit doses, rip the paperboard, or saturate the board with their saliva. In one example, the paperboard is greater than 8 point (pt) (0.203 mm), in another example greater than 11 pt (0.280 mm), in another example greater than 14 pt (0.356 mm), and in another example greater than 15 pt (0.381 mm). In another example, the paperboard ranges from 10 pt (0.254 mm) to 20 pt (0.508 mm), in another example from 12 pt (0.305 mm) to 19 pt (0.483 mm), in another example from 14 pt (0.356 mm) to 18 pt (0.457 mm).

The paperboard can be bleached or unbleached. In one example, the paperboard is coated on at least one side, with a conventional coating that is compatible with the printing method. The coated side allows the surface to be printed with indicia. This coating can be the first or second printable layer.

The blister package can further comprise one or more tear resistant layers. The tear resistant layer can be on the top face of the protection layer or the access layer, the bottom face of the protection layer or the access layer, or between the top face and the bottom face of the protection layer or the access layer. In one example, one tear resistant layer overlies the bottom face of the protection layer and another tear resistant layer overlies the top face of the access layer. The tear resistant layer can be affixed by any suitable means. In one example, the tear resistant layer is affixed to the protection layer or the access layer by an adhesive layer, which can comprise a polyolefin material like low density polyethylene (LDPE).

The tear resistant layer can comprise any suitable material including polymers, cellulose, metal, and combinations thereof. The chemical structure of the tear resistant layer can contribute to its strength. In one example, the tear resistant material is made out of a polymer. In one example, the tear resistant layer can include n-axially oriented films, e.g. MYLAR™, which is a biaxially oriented polyester, oriented nylon, e.g. DARTEK™, cross-laminated polyolefin film, e.g. VALERON™ or INTERPLUS™, which are high density polyolefins.

The tear resistant layer can reduce or prevent children biting through the protection layer and the access layer. Another advantage to the tear resistant layer is that it makes it more difficult for a child to access the unit doses by tearing or peeling the protection layer and/or the access layer. The tear resistant layer can be comprised of any suitable material. Non-limiting examples of blister layer materials can be selected from the group consisting of polyvinyl chloride, polyvinylidene chloride, polypropylene, polyethylene, polychlorotrifluoroethylene, cyclic olefin copolymer, aluminum, and combinations thereof.

The blister layer or portions of the blister layer, such as the cavities, can be transparent. In one example, the blister layer or portions of the blister layer are transparent, which allows the consumer to see the unit dose inside and assists with selecting the correct medication. In another example, the blister layer or portions of the blister layer, such as the cavities, are opaque. The opaque blister layer can add an additional child-resistant feature.

The blister layer can be made of any suitable material, such as a bite resistant material. In one example, the blister layer is made from a polymer. The polymer can be selected from the group consisting of polyvinyl chloride, polyvinylidene chloride, polypropylene, polyethylene, polychlorotrifluoroethylene, cyclic olefin copolymer, aluminum, and combinations thereof. The blister layer can also comprise amorphous polyethylene (APET), polyethylene terephthalate (PETE), polyethylene terephthalate with a glycol modifier (PETG), and combinations thereof.

In one example, the package further comprises a lidding layer. The lidding layer can help protect the unit dose from the elements, for example, moisture or excessive oxygen. The lidding layer can be made from any acceptable material including cellulose, metal, a polymer, or combinations thereof. In one example, the lidding layer is a frangible material such as aluminum foil. In one example, the lidding layer does not have a line of weakness.

In one example, the child-resistant package further comprises a second lidding layer. The second lidding layer can be made out of cellulose, metal, a polymer, or combinations thereof. In one example, the second lidding layer is made out of paperboard.

In one example, the child-resistant blister package can be given a rating that is referred to as the F value. The F Values refers to the number of unit doses to which access is considered a test failure. The number following the "F" refers to the number of unit doses that may produce serious personal injury or serious illness based on a 25-pound (11.4 kg) child.

The Child-Resistant Test is a standardized test and can be found in 16 C.F.R. §1700 Poison Prevention Packaging. In one example, the child-resistant package is an F=1 package, in another example an F=2 package, in yet another example an F=3 package, in another example an F=4 package, and in yet another example an F=5 package.

In one example 80% or more of the children in the child resistance test cannot access 5 doses or less, in another example 70% or more of the children cannot access 5 doses or less, in another example 60% or more of the children cannot access 5 doses or less. In another example 80% or more of the children in the child resistance test cannot access 4 doses or less, in another example 70% or more of the children cannot access 4 doses or less, in another example 60% or more of the children cannot access 4 doses or less. In another example, 80% or more of the children in the child resistance test cannot access 3 doses or less, in another example 70% or more of the children cannot access 3 doses or less, in another example 60% or more of the children cannot access 3 doses or less. In another example, 80% or more of the children in the child resistance test cannot access 2 doses or less, in another example 70% or more of the children cannot access 2 doses or less, in another example 60% or more of the children cannot access 2 doses or less.

In one example, the blister package contains more than one unit dose and the unit doses can have different compositions. For example, at least one unit dose may contain or have a different active, different loading (e.g., different amounts of an active), a different color, a different marking, a different size and/or a different shape than the other unit dose(s). For example, one or more unit doses may be administered during the day when sedation is not desired and another unit dose(s) may be administered during the night when stimulation is not desired. In one example, one or more unit doses contains a non-sedating antihistamine and/or decongestant, but not sedating antihistamine and the other unit dose(s) contain a sedating or non-sedating antihistamine, but not stimulating nasal decongestant. Of course, other active ingredients are possible, some of which are set forth below.

Any suitable active or combination of actives can be utilized in the child-resistant package, including ingredients that are generally put in child-resistant containers which can include most oral human prescription drugs, drugs which were once available by prescription but are now available over-the-counter plus other non-prescription drug preparations containing for example, aspirin, acetaminophen, diphenhydramine, ibuprofen, naproxen, omeprazole, loratadine, cetirizine, fexofenadine, loperamide, lidocaine, and iron containing drugs and supplements.

The unit dose forms can include active ingredients which can be selected from the following non-limiting list of classes of actives including: analgesics, anesthetics, antacids, antiasthmatics, antibiotics, anti-cholinergics, antidepressants, anti-diarrheal, antidiuretics, anti-emetic, antiflattulants/anti gas agents, antihistamines, antihyperactives, antihypertensives, anti-inflammatories, antimicrobials, antimigraine agents, antipyretics, antispasmodics, antitussives, anti-virals, anorexics, anxiolytics, beta blockers, decongestants, demulcents, diuretics, enzymes, expectorants, $H_2$ receptor antagonists, laxatives, mucolytics, non-sedating antihistamines, non-steroidal anti-inflammatory drugs, oligonucleotides, peptides, proteins, proton pump inhibitors, rafting agents, sedatives, sleep aids, tranquilizers, and combinations thereof. Exemplary actives are described, for example, in U.S. application Ser. No. 13/173,786.

The unit dose forms can include additional ingredients including but not limited to fiber, probiotics, prebiotics, vitamins, minerals, elements, plant-derived materials, energy-boosting materials, supplements, sensory agents, and combinations thereof.

The actives in the unit dose may also be selected from the group consisting of delayed release actives, extended release actives, immediate release actives, pulsatile release actives, and combinations thereof.

Users may desire a variety of benefits from the actives in the unit dose, non-limiting examples of which include reduced incidence and severity of respiratory conditions and symptoms thereof including but not limited to influenza, the common cold, allergies; pneumonia, bronchitis, and other viral infections; pneumonia, bronchitis, and other bacterial infections; asthma, sinusitis; rhinitis; runny nose, nasal and/or chest congestion, cough, sneezing, pressure, headache, aches, fever, fatigue and/or sore throat, and combinations thereof; reduced incidence and severity of gastrointestinal conditions and symptoms thereof including but not limited gastroesophogeal reflux disease, gastritis, peptic ulcers, dyspepsia, irritable bowel syndrome, colitis, Crohn's disease, Barrett's esophagus, gastrinoma, diarrhea, indigestion, constipation, obesity, pouchitis, diverticulitis, enteritis, enterocolitis, dysphagia, inflamed hemorrhoids, food poisoning and other bacterial infections, influenza and other viral infections, upset stomach, vomiting, sour stomach, cramps, gas, bloating, stomach ache, and combinations thereof; reduced incidence and severity of pain and inflammation conditions and symptoms thereof, which may be acute or chronic, intense or mild, including but not limited headache, migraine, back ache, menstrual cramps, dental pain, muscle strain, joint pain and/or stiffness, arthritis, pinched nerves, post surgical pain and combinations thereof; reduced incidence and severity of Central Nervous System conditions and symptoms thereof including but not limited to insomnia, restless leg syndrome, narcolepsy, pain, tobacco dependence, depression, attention deficit disorder, attention deficit hyperactivity disorder, abnormal circadian rhythm, fatigue, drowsiness, difficulty concentrating, irritation, vomiting, nausea, and combinations thereof; reduced incidence and severity of symptoms of disorders of the ear, nose and throat; reduced incidence and severity of symptoms and effects of: immunodeficiency, cancer (particularly those of the gastrointestinal and immune systems), appendicitis, autoimmune disorders, multiple sclerosis, Alzheimer's disease, amyloidosis, rheumatoid arthritis, diabetes mellitus, insulin resistance, bacterial infections, viral infections, fungal infections, periodontal disease, urogenital disease, surgical associated trauma, surgical-induced metastatic disease, sepsis, weight loss, weight gain, excessive adipose tissue accumulation, anorexia, fever control, cachexia, wound healing, ulcers, gut barrier infection, circulatory disorders, coronary heart disease, anaemia, disorders of the blood coagulation system, renal disease, hepatic disease, ischaemia, nutritional disorders, osteoporosis, endocrine disorders, epidermal disorders, depressed immune system, birth defects in newborns, eye diseases, night blindness, beriberi, pellagra, scurvy, rickets, low hormone levels, and combinations thereof.

Non-limiting examples of health benefits include ameliorating or reducing the effects of aging including mental awareness and activity levels, preventing weight loss during and following infection; improving glucose control, including improving insulin sensitivity, reducing insulin resistance, and attenuating postprandial glucose absorption; good, maintained and/or improved mobility and joint function; lowered cholesterol and lowered blood pressure; improved skin look and tone, improved hair look and feel, and combinations thereof.

The child-resistant package can be any size. In one example, the child-resistant package is portable and can easily fit in a purse or wallet. For example, the child-resistant package can be from 50 mm to 120 mm wide, from 60 mm to 100 mm wide, and from 65 mm to 95 mm wide and from 30 mm to 100 mm tall, from 40 mm to 90 mm tall, from 50 mm to 80 mm tall, and from 60 mm to 70 mm tall. In another example, the child-resistant package can be from 50 mm to 150 mm wide, from 70 mm to 130 mm wide, and from 90 mm to 120 mm wide and from 40 mm to 120 mm tall, from 50 mm to 180 mm tall, and from 65 mm to 140 mm tall. In yet another example, the child-resistant package can be from 20 mm to 90 mm wide, in another example from 30 mm to 70 mm wide, and in another example from 40 mm to 60 mm wide and from 20 mm to 90 mm tall, in another example from 30 mm to 70 mm tall, and in another example from 40 mm to 60 mm tall.

The child-resistant package can include any number of cavities and unit doses. In one example, the package includes 24 hours of medication according to the dosage instructions, in another example 48 hours of medication, in another example 72 hours, in another example 96 hours, in another example in 120 hours, another example 144 hours, and in another example 192 hours. In another example the package includes from 10 to 24 hours of medication, in another example from 12 to 24 hours of medication, in another example from 14 to 24 hours of medication, and in another example from 16 to 24 hours of medication. In another example, the package includes from 24 hours to 144 hours of medication, in another example from 48 hours to 120 hours, and in another example from 72 hours to 96 hours.

In one example the package has 1 cavity, in another example 2 cavities, in another example 3 cavities, in another example 4 cavities, and in another example 5 cavities. In another example, the package has from 6 cavities to 24 cavities, in another example from 7 cavities to 18 cavities, in another example from 8 cavities to 16 cavities, and in another example from 8 cavities to 12 cavities.

Each cavity can has one unit dose or a plurality of unit doses. In one example, the cavity has one unit dose, in another example the cavity comprises two unit doses, and in another example each cavities has more than 2 unit doses.

Indicia can be printed and viewable on the top face or the bottom face of the blister package. The indicia can include regulatory information, dosage details, ingredients, manufacturer information, warnings, etc. In one example, the instructional indicia including any regulatory information may be located such that the regulatory information is not damaged when a unit dose is removed from at least one of the cavities through the bottom face.

Generally, the systems described above are directed to a blister package, blister package or blister sheet, all used interchangeably. The blister packages can be of varying shape and size as desired based upon the number, size and type of dosing units contained therein, and can be sized to be conveniently portable. Non-limiting examples of such shapes include round, circular, oval, rectangular, square, triangular, trapezoidal, octagonal, and combinations thereof. The blister packages can also be formed to have means to permit separation of one or more portions of the blister packages, i.e. one or more portions containing an enclosure.

Non-limiting examples of such means include perforations, scoring and combinations thereof. Additional examples can be found in U.S. application Ser. No. 12/971,677.

Test Methods

Child-Resistant Testing

The child-resistant testing can be conducted according to the Code of Federal Regulations Title 16: Part 1700.

Child-Resistant Screening Test

The Child-Resistant Screening Test can be conducted as follows:

For the Child-Resistant Screening Test the children are between 42-51 months of age. Both boys and girls are selected.

A test failure is defined as any child who opens or gains access to the number of individual units which constitute the amount that may produce serious personal injury or serious illness, during the full 10 minutes of testing. For the following experiments, the test was a failure if any child accessed two or more tablets during the full 10 minutes of testing.

The children are tested two at a time. The two children are escorted to the test area and are seated so there is no physical barrier between the children and the tester. The tester will talk to the children to make them at ease. The children are not given the impression that they are in a race or a contest, they are not offered a reward, and they are not told that the test is a game or that it is fun. To begin the test the tester shall hand the children identical packages and say "Please try and open this for me." If the child refuses to participate after the test has started, the tester shall reassure the child and gently encourage the child to try. If the child continues to refuse, the tester shall ask the child to hold the package in his/her lap until the other child is finished. This pair of children shall not be eliminated from the results unless the refusing child disrupts the participation of the other child.

Each child will be given up to 5 minutes to open his/her package. The tester shall minimize conversations with the children as long as they continue to attempt to pen their packages. The tester shall not discourage the children verbally or with facial expressions. If a child gets frustrated or bored and stops trying to open his/her package, the tester shall reassure the child and gently encourage the child to keep trying. The children should be allowed freedom of movement to work on their packages as long as the tester can watch both children (e.g. they can stand up, get down on the floor, or bang or pry the package). The children shall be allowed to talk to each other about opening the packages and shall be allowed to watch each other try to open packages. If the child opens his/her package, the tester shall say, "Thank you," and take the package from the child.

At the end of the 5-minute period, the tester shall demonstrate how to open the package if either child has not opened his or her package. Prior to the beginning of the demonstration, the tester shall ask the children to set their packages aside. The children shall not be allowed to continue to try to open their packages during the demonstration period. The tester shall say, "watch me open my package." Once the tester gets the children's full attention, the tester shall hold the demo package approximately two feet from the children and open the package at a normal speed as if the tester were going to use the contents. There shall be no exaggerated opening movements. The tester shall not discuss or describe how to open the package.

Then, the children are given a second five-minute period to try and open their packages. The tester begins the five minute period by saying, "now you try to open your packages." If one or both children have not used their teeth to try to open their packages during the first 5 minutes, the tester shall say immediately before beginning the second 5-minute period, "You can use your teeth if you want to." This is the only statement that the tester shall make about using teeth. The test shall continue for another five minutes or until both children have opened their packages, whichever comes first.

Force Testing Method

Figure 12A:
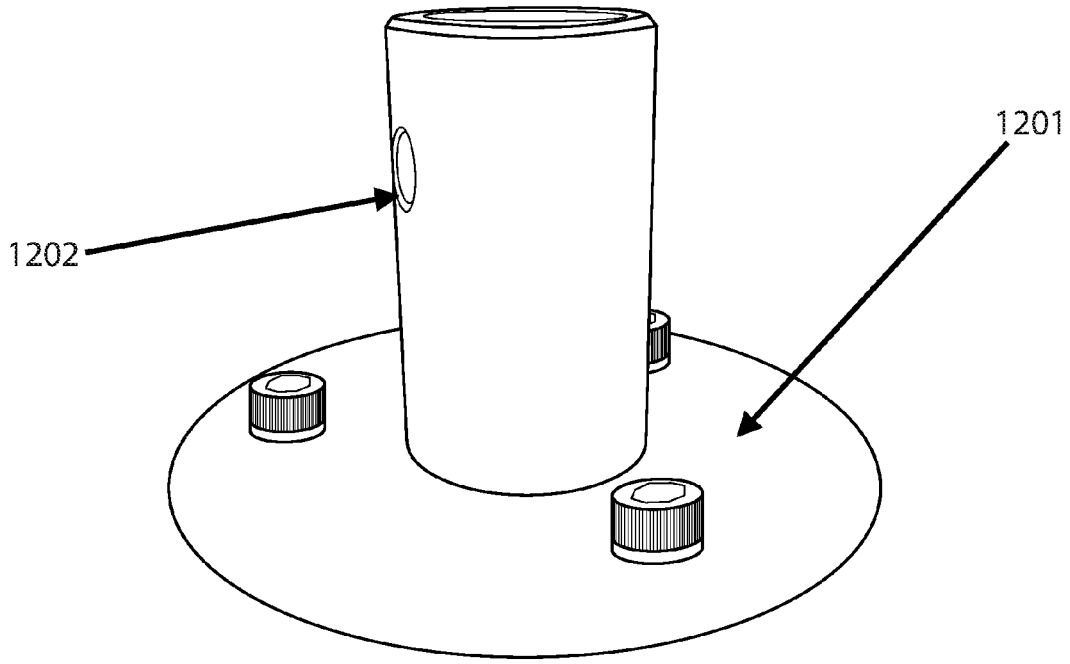
FIG. 12A is an Instron® base used in the Force Testing Method.

The Force Testing Method can be conducted as follows:

First, turn on the Instron® Model #5566 (available from Instron®, Norwood, Mass.) and load the BlueHill™ 2 software (available from Instron®). Ensure that the Instron® Load Cell Height is correct, which means that it is equal to the blister package height, measured from the top of the blister cavity, plus 5 mm. If the Load Cell Height is not correct the operator can adjust the operation height with the Instron® control panel by using the jog arrow up or down. Start with Instron® base 1201, as illustrated in FIG. 12A, if necessary remove all equipment attached to Instron® base 1201.

Figure 12B:
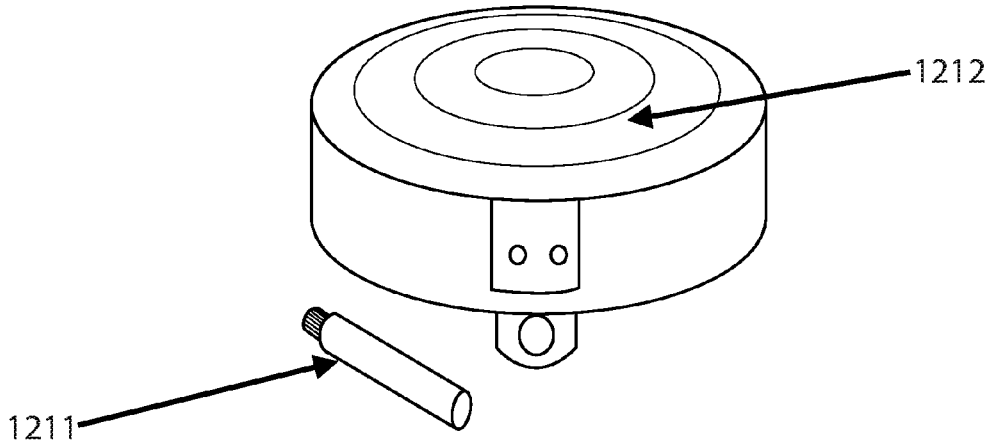
FIG. 12B is a compression platen and pin used in the Force Testing Method.

Next, insert compression platen 1212 (available from Instron®) as illustrated in FIG. 12B, into the Instron® base 1201. Then secure compression platen 1212 into the Inston® base using pin 1211 through hole 1202 on the right side of the Instron® base 1201, when fully inserted pin 1211 will partially poke out both sides of hole 1202 in Instron® base 1201 and compression platen 1212 thereby securing compression platen 1212 to the Instron® base 1201, as illustrated in FIG. 12A and FIG. 12B.

Figure 12C:
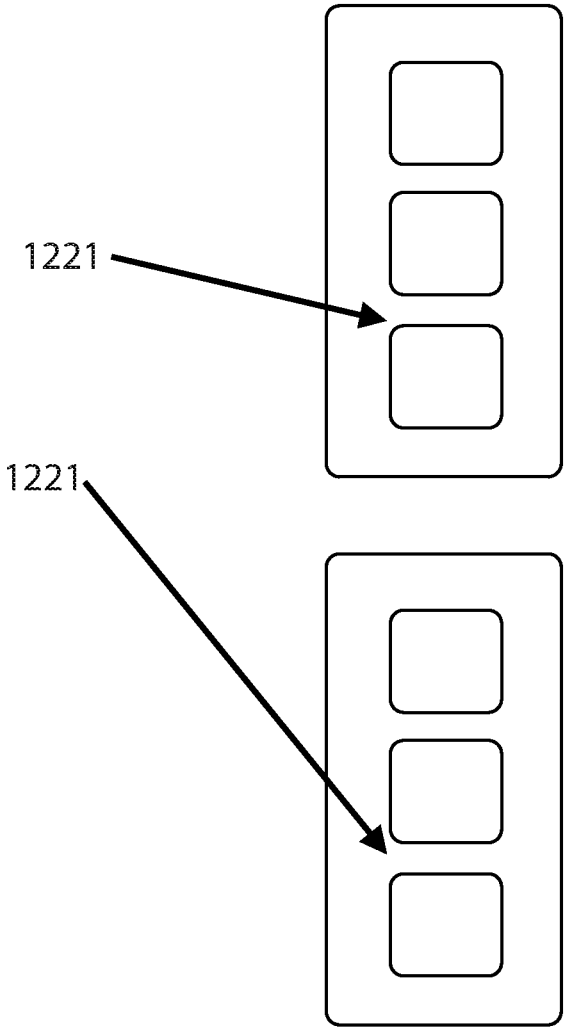
FIG. 12C are restraint plates used in the Force Testing Method.

Restraint plates 1221, as shown in FIG. 12C, are used to secure a blister package during testing. Restraint plates 1221 are made from a material that is sturdy enough that it does not flex during testing.

Figure 12D:
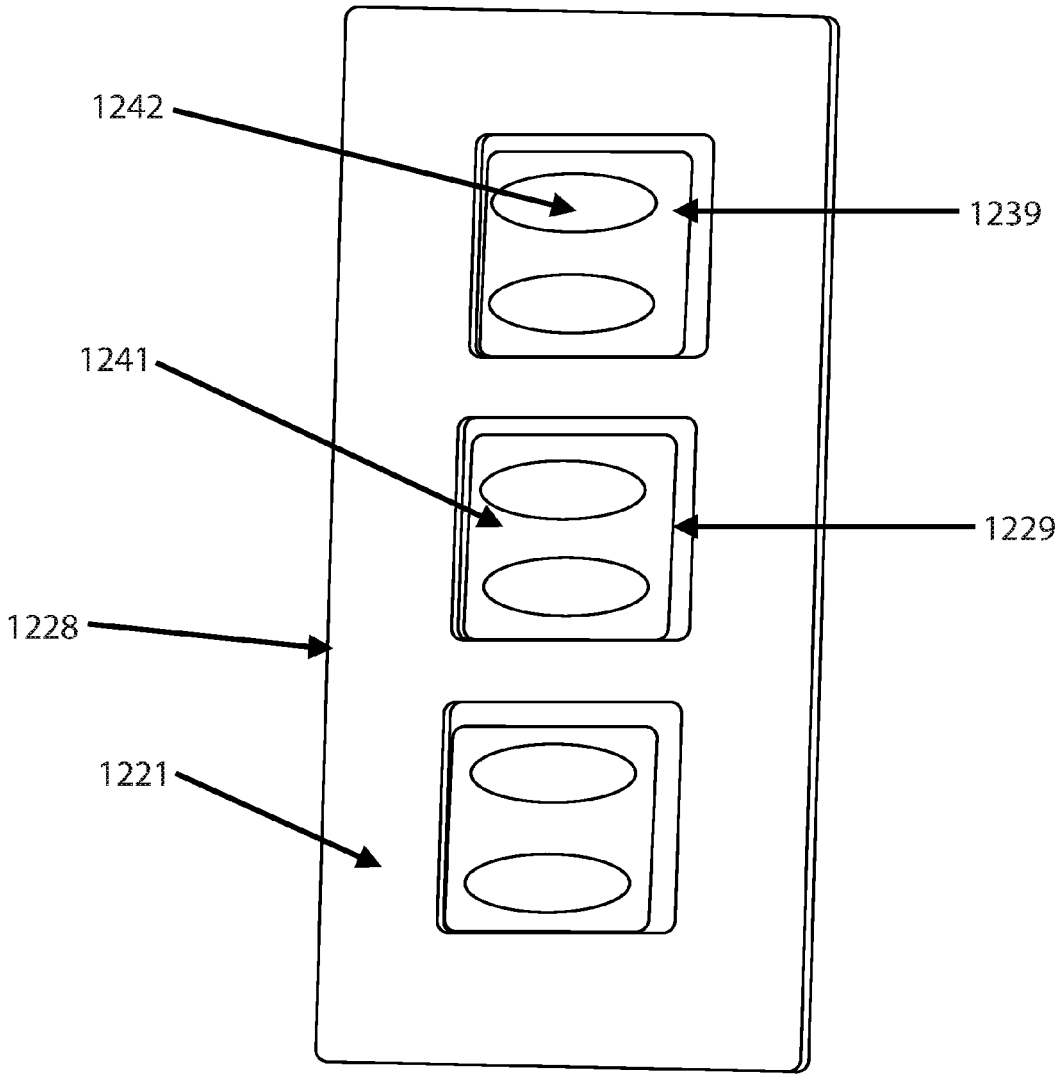
FIG. 12D is a view of a sample blister card sandwiched between two restraint plates, used in the Force Testing Method.

Blister package 1239 is centered to prevent interference between the ball probe and restraint plates during testing and then sandwiched between two restraint plates 1221 to create sandwiched blister package 1228, as illustrated in FIG. 12D. Restraint plate 1221 is designed for blister package 1239, which has two tablets 1242 per blister cavity 1241. Restrain plate 1221 surrounds blister package 1239 except plate opening 1229 is large enough for blister cavity 1241 to extend through. Furthermore, the area directly underneath blister cavities 1241 is not supported by restraint plates 1221 which allows each tablet 1242 to be pushed through the access layer when performing the force test.

Figure 12E:
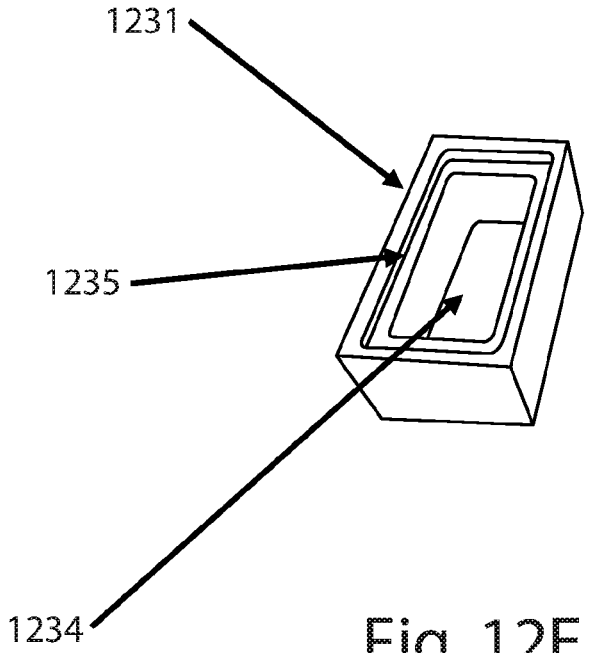
FIG. 12E is a tray used in the Force Testing Method.
Figure 12F:
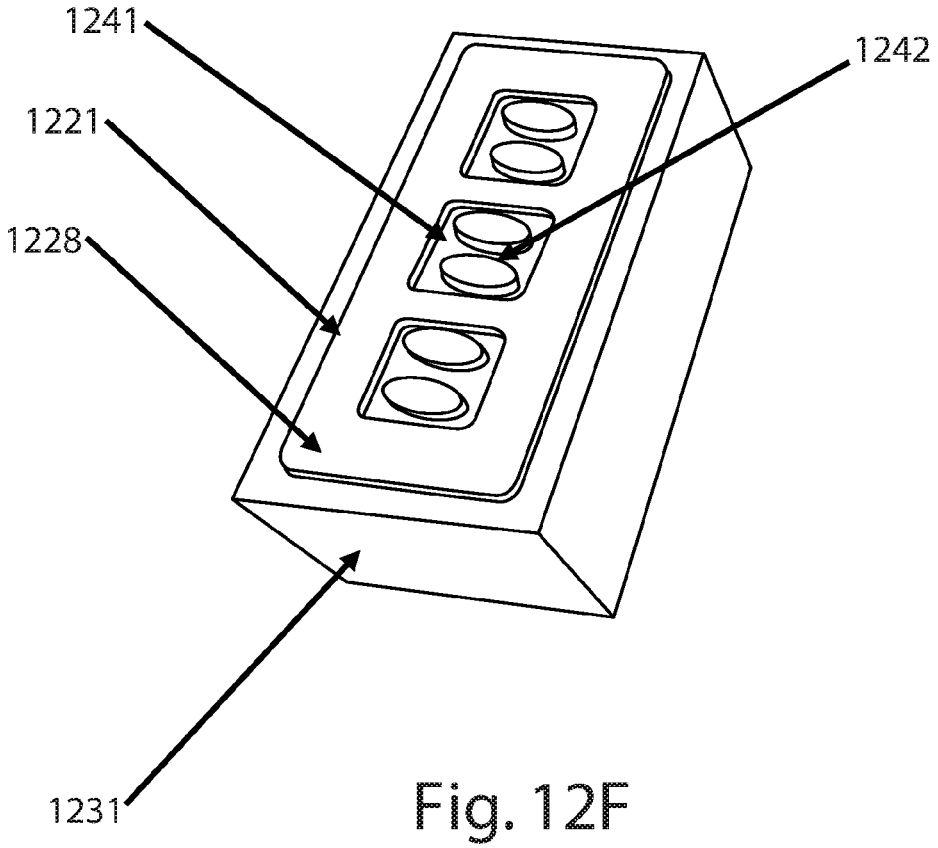
FIG. 12F is a view of a sample blister card sandwiched between two restraint plates, supported by a tray, used in the Force Testing Method.

Tray 1231, is shown in FIG. 12E. Tray 1231 has depression 1234 which catches the expelled tablets 1242. Tray 1231 has lip 1235, that supports the outer edge of restraint plate 1221, as shown in FIG. 12E and FIG. 12F. Tray 1231 is designed for blister package 1229 and restraint plates 1221.

Next, the sandwiched blister package 1228 is placed onto tray 1231 so the lower restraint plate 1221 is supported by lip 1235 of tray 1231, as illustrated in FIG. 12F. Cavities 1241 in blister package 1239 face up.

Figure 12G:
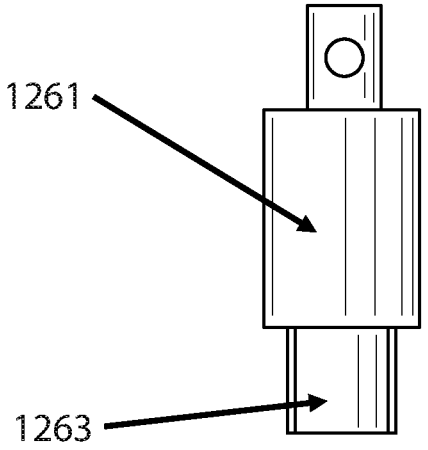
FIG. 12G is a ball probe used in the Force Testing Method.

Ball probe 1261 is illustrated in FIG. 12G. Ball probe 1261 is made from aluminum, has contact surface 1263 that is 0.75 in by 0.75 in (19.05 mm×19.05 mm) and is used to test blister package 1229 with two tablets 1242 per cavity 1241. Ball probe 1261 is designed so when the test is conducted, contact surface 1229 touches between 50% and 80% of cavity 1241.

Figure 12H:
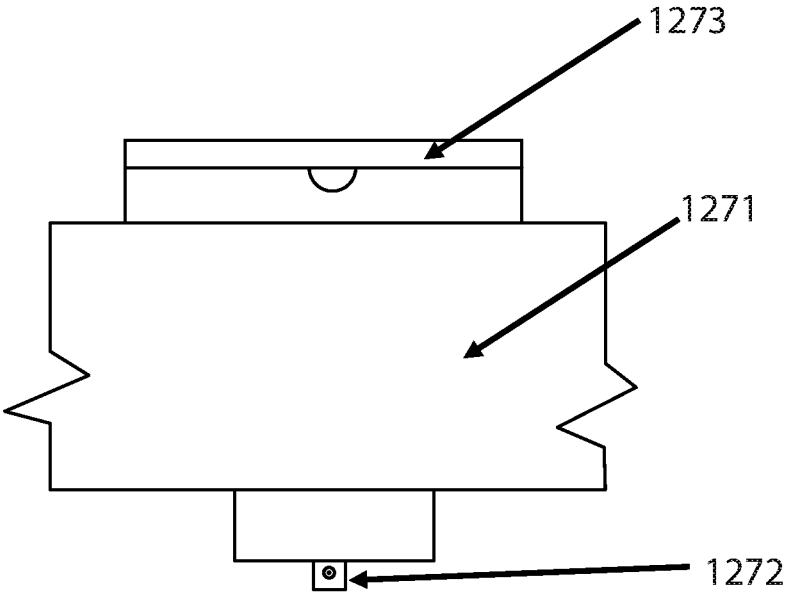
FIG. 12H is the load cell used in the Force Testing Method.

Ball probe 1261 is attached to the Instron® frame 1271 at the ball probe attachment point 1272 and secured using a pin, as shown in FIG. 12H. The Instron® frame 1271 is seen in FIG. 12H. One kN load cell 1273 (available from Instron®) is used in the Instron® machine for this testing process, as illustrated in FIG. 12H.

After the Instron® is set up, align the sandwiched blister package 1228 in tray 1231 on the compression platen 1212 until there is a 5 mm gap in between ball probe 1261 and the top of blister cavity 1241. Ball probe 1261 is centered in both the x and y-axis above blister cavity 1241. The compression platen 1212 should not be touched after the positioning. Then the "Reset GL" (gauge length) button on the control panel of the Instron® is pressed to reset the gauge length of the load cell.

Then utilize the Bluehill™ 2 software to write an appropriate test method and collect data during the test so when the BALANCE LOAD button and BALANCE STRAIN button is clicked at the top left side of the page the load will "zero" and when the start button is clicked on the right hand side of the page the test will begin. The method should be programmed to move ball probe 1261 downward at a rate of 50 mm/min with an extensions distance that allows for the blister package to be opened, exposing tablet 1242. Once the unit doses have been removed, the probe should be programmed to stop and to remove sandwiched blister package 1228 and return to gauge length. Then click ok.

Then the ball probe 1261 will return to GL. At this point tablets 1242 may not have dropped out of the blister package. If this happens, it is acceptable to manually remove tablets 1242. These steps are then repeated for the next cavities and/or blister packages to be tested. Various data, including force, can be programmed to be collected during this testing process. Data collection can include, but not limited to, such characteristics as time at break, compressive load at break, energy at break, time at maximum compressive load, compressive extension at maximum compressive load, maximum compressive load, energy at maximum compressive load, etc. This data can then be used in turn to characterize force needed to extract a medicament from a push-through blister package. The compressive load at break is the force required to remove tablet 1242 from blister package 1239.

Figure 12I:
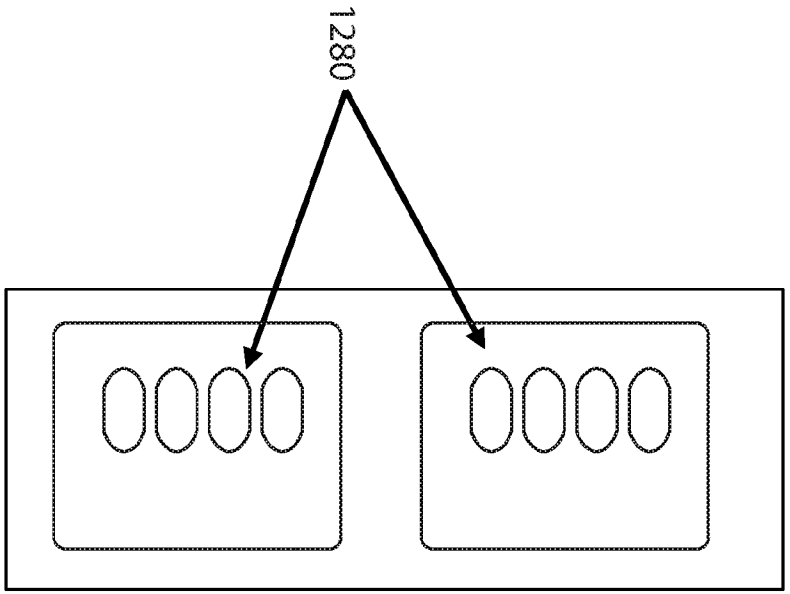
FIG. 12I are restraint plates used in the Force Testing Method.
Figure 12J:
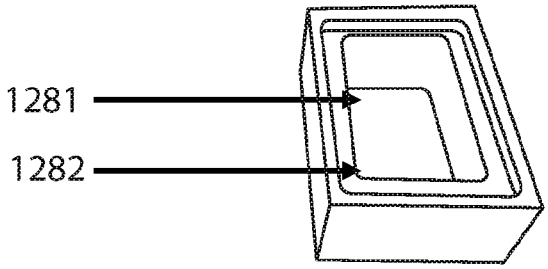
FIG. 12J is a tray used in the Force Testing Method.
Figure 12K:
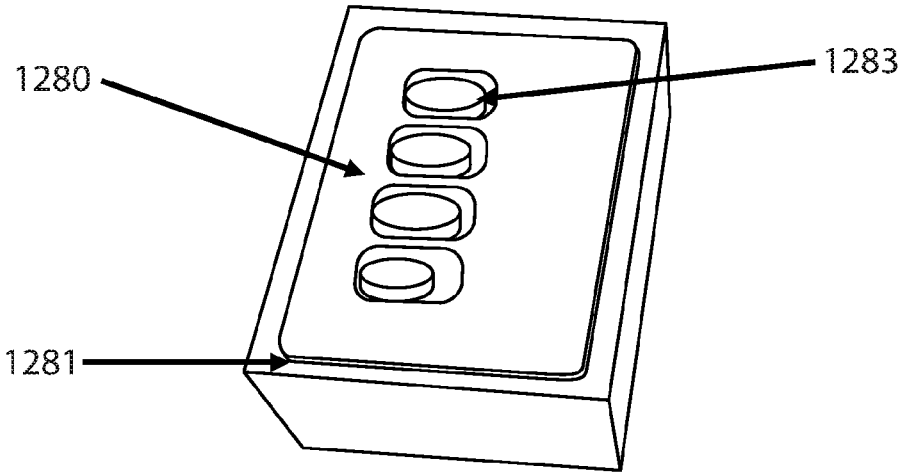
FIG. 12K is a view of a sample blister card sandwiched between two restraint plates, supported by a tray, used in the Force Testing Method.
Figure 12L:
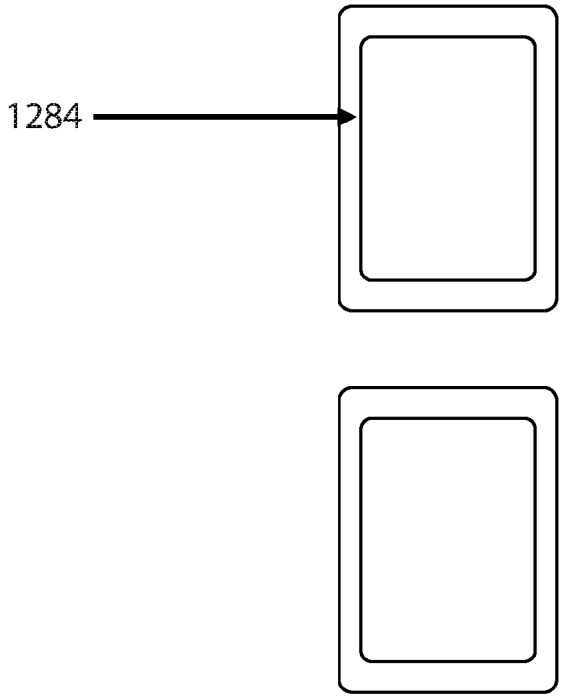
FIG. 12L are restraint plates used in the Force Testing Method.
Figure 12M:
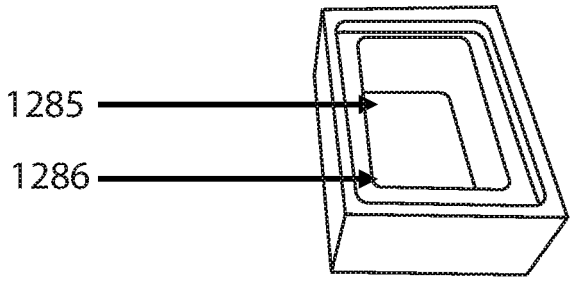
FIG. 12M is a tray used in the Force Testing Method.
Figure 12N:
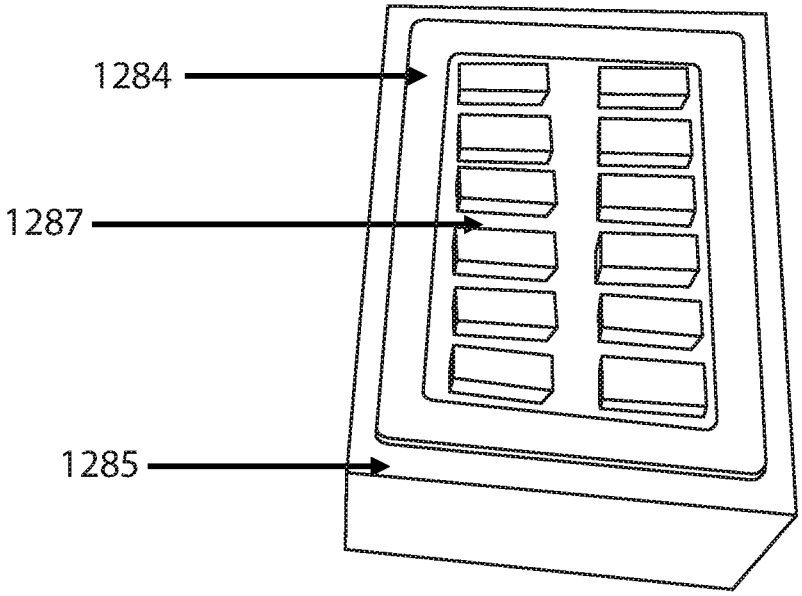
FIG. 12N is a view of a sample blister card sandwiched between two restraint plates, supported by a tray, used in the Force Testing Method.

This test method can also be performed using different restraint plates, tray, and ball probe that are designed to fit a blister package with a different number of cavities, cavity size, and/or tablets per cavity. For example, FIG. 12I shows restraint plates 1280 and FIG. 12J shows tray 1281. Tray 1281 has lip 1282, that supports the outer edge of restraint plate 1280, as shown in FIG. 12K. Restraint plates 1280 and tray 1281 are designed for blister package 1282, which has four cavities and each cavity has one tablet. Another example, FIG. 12L shows restraint plates 1284 and FIG. 12M shows tray 1285. Tray 1285 has lip 1286, which supports the outer edge of restraint plate 1284, as shown in FIG. 12K. Restraint plates 1284 and tray 1285 are designed for blister package 1287, which has twelve cavities.

Example 1

This Example shows the results from the Child-Resistant Screening Test when different aspects of the blister package such as the thickness of the paperboard, the width of the joined region, the composition of the blister layer, whether or not a tear resistant layer was present, and the perforation pattern.

The procedures for the Child-Resistant Screening Test were followed as described above. Each trial used a blister package with four cavities and each cavity contained one unit dose. The table below summarizes the results from this test. The perforation pattern, E shown in FIG. 11A, M shown in FIG. 11B, and Z shown in FIG. 11C. The percentages in the chart refer to the percentage of children who passed the child-resistant testing. In order to pass the child-resistant testing the children were able to access one unit does or less during the entire ten minute period.

Test 1: The blister package had a low seal, which means that the joined region was less than 0.5 in (1.27 cm) wide. The blister package was made out of 12 pt (0.305 mm) paperboard. The package had a soft blister layer made from polyvinyl chloride (PVC). The soft blister layer was about 188 microns (μm) thick. There was no tear resistant layer.

Test 2: The blister package had a low seal, which means that the joined region was less than 0.5 in (1.27 cm) wide. The blister package was made out of 10 pt (0.254 mm) paperboard. The package had a soft blister layer made from PVC, the soft blister layer was about 188 μm thick. There was a tear resistant layer made from a polymer, located between the protection layer and the access layer.

Test 3: The blister package had a low seal, which means that the joined region was less than 0.5 in (1.27 cm) wide. The blister package was made out of 10 pt (0.254 mm) paperboard. The package had a hard blister layer made from 250 μm PVC combined with 50 μm polychlorotrifluoroethylene (PCTFE). There was a tear resistant layer made from a polymer, located between the protection layer and the access layer.

Test 4: The blister package had a high seal, which means that the joined region was greater than or equal to 0.5 in (1.27 cm) wide. The blister package was made out of 10 pt (0.254 mm) paperboard. The package had a hard blister layer made from 250 μm PVC combined with 50 μm PCTFE. There was a tear resistant layer made from a polymer, located between the protection layer and the access layer.

Test 5: The blister package had a high seal, which means that the joined region was greater than or equal to 0.5 in (1.27 cm) wide. The blister package was made out of 16 pt (0.406 mm) paperboard. The package had a hard blister layer made from 250 μm PVC combined with 50 μm PCTFE. There was a tear resistant layer made from a polymer, located between the protection layer and the access layer.

| Perforation Type | Test 1<br>12 pt<br>Low Seal<br>Soft Blister Layer | Test 2<br>10 pt<br>Low Seal<br>Soft Blister Layer<br>Tear Resistant Layer | Test 3<br>10 pt<br>Low Seal<br>Hard Blister Layer<br>Tear Resistant Layer | Test 4<br>10 pt<br>High Seal<br>Hard Blister Layer<br>Tear Resistant Layer | Test 5<br>16 pt<br>High Seal<br>Hard Blister Layer<br>Tear Resistant Layer |
|---|---|---|---|---|---|
| X<br>(FIG. 11A) | 20%<br>N = 20 children | 70%<br>N = 10 children | | 70%<br>N = 10 children | 70%<br>N = 10 children |
| Y<br>(FIG. 11B) | | | 74%<br>N = 38 children | 75%<br>N = 20 children | 61%<br>N = 18 children |

-continued

| Perforation Type | Test 1 12 pt Low Seal Soft Blister Layer | Test 2 10 pt Low Seal Soft Blister Layer Tear Resistant Layer | Test 3 10 pt Low Seal Hard Blister Layer Tear Resistant Layer | Test 4 10 pt High Seal Hard Blister Layer Tear Resistant Layer | Test 5 16 pt High Seal Hard Blister Layer Tear Resistant Layer |
|---|---|---|---|---|---|
| Z (FIG. 11C) | | 60% N = 10 children | | 80% N = 20 children | 100% N = 20 children |

As shown above, Test 5 with the Z perforation pattern had the greatest percentage of children passing the Child-Resistant Screening Test while Test 1 with the X perforation pattern had the fewest number of children pass the Child-Resistance Screening Test. Furthermore, adding the tear resistant layer resulted in a higher number of children passing the Child-Resistant Screening Test.

Values disclosed herein as ends of ranges are not to be understood as being strictly limited to the exact numerical values recited. Instead, unless otherwise specified, each numerical range is intended to mean both the recited values and any integers within the range. For example a range disclosed as "1 to 10" is intended to mean "1, 2, 3, 4, 5, 6, 7, 8, 9, 10."

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular examples of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A child-resistant blister package comprising:

a protection layer comprising a bottom face;

a first tear resistant layer;

a second tear resistant layer comprising a bottom face;

a blister layer disposed between the first tear resistant layer and the second tear resistant layer, wherein one or more cavities are formed therein, and wherein each cavity contains at least one unit dose;

a first lidding layer;

a second lidding layer; and an access layer comprising a top face and a bottom face, wherein the access layer has a line of weakness comprising a perforation pattern and a kiss cut;

wherein the protection layer and the access layer are permanently joined around a blister package periphery;

wherein the bottom face of the protection layer is in a face to face relationship with the first tear resistant layer;

wherein the first lidding layer overlies the one or more cavities and is in a face to face relationship with the second lidding layer;

wherein the bottom face of the second tear resistant layer is in a face to face relationship with the access layer;

wherein the perforation pattern is on the bottom face of the access layer and extends partially into the second tear resistant layer; and wherein the kiss cut is on the bottom face of the access layer and extends partially towards the top face of the access layer.

2. The child-resistant blister package of claim 1 wherein the protection layer and the access layer have a thickness of from about 10 pt (0.254 mm) to about 20 pt (0.508 mm).

3. The child-resistant blister package of claim 1 wherein the blister layer comprises a material selected from the group consisting of polyvinyl chloride, polyvinylidene chloride, polypropylene, polyethylene, polychlorotrifluoroethylene, cyclic olefin copolymer, aluminum, and combinations thereof.

4. The child-resistant blister package of claim 1 wherein the perforation pattern comprises a plurality of cuts and lands, and wherein the ratio of cut length to land length is from 3:1 to 1:3.

5. The child-resistant blister package of claim 1 wherein the perforation pattern comprises a plurality of cuts and lands, and wherein the cuts are less than 5 mm in length.

6. The child-resistant blister package of claim 1 wherein each cavity contains one unit dose.

7. The child-resistant blister package of claim 1 wherein each cavity contains two or more unit doses.

8. A child-resistant blister package comprising:

a protection layer comprising a bottom face;

a first tear resistant layer;

a blister layer, wherein one or more cavities are formed therein, and wherein each cavity contains at least one unit dose; and an access layer comprising a top face and a bottom face, wherein the access layer comprises a line of weakness on the bottom face that extends at least partially towards the top face;

wherein the bottom face of the protection layer is in a face to face relationship with the first tear resistant layer;

wherein the blister layer is disposed between the first tear resistant layer and the access layer;

wherein the protection layer and the access layer are permanently joined around a blister package periphery;

wherein the line of weakness comprises a kiss cut and a perforation pattern, wherein the perforation pattern comprises a plurality of cuts and lands and the number of cuts is about 20 to about 43.

9. The child-resistant blister package of claim 8 wherein the protection layer and the first tear resistant layer comprise one or more openings, and wherein the one or more cavities at least partially extends through the openings.

10. The child-resistant blister package of claim 8 comprising a second tear resistant layer, wherein the blister layer is disposed between the first tear resistant layer and the second tear resistant layer, wherein the second tear resistant layer has a bottom face and the bottom face is in a face to face relationship with the top face of the access layer.

11. The child-resistant blister package of claim 8 comprising a lidding layer which overlies the one or more cavities and is located between the blister layer and the access layer.

12. The child-resistant blister package of claim 11 wherein the lidding layer comprises a material selected from the group consisting of metal, cellulose, polymer, and combinations thereof.

13. The child-resistant blister package of claim 8 wherein the blister package is from about 50 mm to about 120 mm wide and from about 30 mm to about 100 mm tall.

14. The child-resistant blister package of claim 8 wherein the blister package is configured to open the one or more cavities with one push and does not comprise written instructions for how to open the one or more cavities.

15. The child-resistant blister package of claim 8 wherein the blister package comprises from three to five cavities and contains 10 to 24 hours of medication.

16. A child-resistant blister package comprising:

a protection layer comprising a bottom face;

a first tear resistant layer;

a second tear resistant layer comprising a bottom face;

a blister layer comprising a periphery, wherein one or more cavities are formed therein, and wherein each cavity contains at least one unit dose; and an access layer comprising a top face and a bottom face, wherein the access layer comprises a line of weakness on the bottom face that extends at least partially towards the top face;

wherein substantially the entire periphery of the blister layer is disposed between the protection layer and the access layer;

wherein the blister layer is disposed between the first tear resistant layer and the second tear resistant layer, wherein the protection layer and the access layer are permanently joined around a blister package periphery;

wherein the first tear resistant layer is in a face to face relationship with the blister layer;

wherein the bottom face of the second tear resistant layer is in a face to face relationship with the top face of the access layer;

wherein the line of weakness comprises a kiss cut and a perforation pattern;

wherein the blister package is configured to open the one or more cavities with one push.

* * * * *